United States Patent [19]

Weber

[11] 4,055,226

[45] Oct. 25, 1977

[54] UNDERREAMER HAVING SPLINED TORQUE TRANSMITTING CONNECTION BETWEEN TELESCOPING PORTIONS FOR CONTROL OF CUTTER POSITION

[75] Inventor: Robert W. Weber, Long Beach, Calif.

[73] Assignee: The Servco Company, a division of Smith International, Inc., Gardena, Calif.

[21] Appl. No.: 736,109

[22] Filed: Oct. 27, 1976

Related U.S. Application Data

[63] Continuation of Ser. No. 668,412, March 19, 1976, abandoned.

[51] Int. Cl.[2] ..... E21B 9/26

[52] U.S. Cl. ..... 175/273; 175/286; 175/321

[58] Field of Search ..... 175/286, 287, 284, 290, 175/321, 322, 275, 279, 273; 166/216, 217, 140, 240

[56] References Cited

U.S. PATENT DOCUMENTS

| | | | |
|---|---|---|---|
| 1,743,528 | 1/1930 | Campbell | 175/280 X |
| 1,810,201 | 6/1931 | Campbell | 175/280 X |
| 2,002,140 | 5/1935 | Dillon | 166/208 UX |
| 2,400,970 | 5/1946 | Baker | 166/240 |
| 3,324,952 | 6/1967 | Berryman | 166/240 |
| 3,352,362 | 11/1967 | Leebourg | 166/240 |
| 3,749,187 | 7/1973 | Leathers | 175/287 X |
| 3,817,339 | 6/1974 | Furse | 175/286 X |
| 3,949,820 | 4/1976 | Furse | 175/286 X |

*Primary Examiner*—Ernest R. Purser
*Assistant Examiner*—William F. Pate, III
*Attorney, Agent, or Firm*—Christie, Parker & Hale

[57] ABSTRACT

An underreamer is disclosed having longitudinally telescoping upper and lower portions connectable respectively to an upper drill string and a lower drill string. A splined connection is provided between the telescoping portions having first and second engaged positions. Both of the engaged positions transmit torque between the telescoping portions. The splined connection provides a different angular and a different longitudinal position for the telescoping portions in each such position. Means is provided for pivotally mounting a cutter arm on one of the telescoping portions. Means is provided on the other telescoping portion for urging the at least one cutter arm relatively outward from the telescoping portions to an extended underreaming position when the splined connection is in its first position. The cutter arm is positioned inwardly to a retracted clearance position when the splined connection is in its second position.

20 Claims, 5 Drawing Figures

UNDERREAMER HAVING SPLINED TORQUE TRANSMITTING CONNECTION BETWEEN TELESCOPING PORTIONS FOR CONTROL OF CUTTER POSITION

CROSS REFERENCE TO RELATED APPLICATIONS

This is a continuation of application Ser. No. 668,412, filed Mar. 19, 1976, now abandoned.

BACKGROUND

This invention relates to underreaming and chambering tools and more particularly to mechanisms in such tools for controlling the position of cutter arms.

Rotary drills are commonly used for earth boring operations. Such drills are employed in oil and gas wells as well as in mining operations. Often it is desired to enlarge the diameter of a hole drilled at some point a substantial distance below the surface. In oil and gas wells this is commonly referred to as underreaming, whereas in mining it is commonly referred to as chambering. For ease of explanation, both operations are generally referred to herein as underreaming.

To effect underreaming operations a variety of underreamers, hole openers, and the like have been devised. With some devices the underreamer can only be installed on the drill string when underreaming operations are taking place. This requires removal of the drill string each time a change is made from straight drilling to underreaming or vice versa.

Other devices employ various controllable cutter actuators to move underreaming cutters into or out of underreaming position while a drill is connected below the underreamer for drilling purposes. Some such devices use fluid pressure, for example, due to recirculating drilling mud or like to actuate a cutter into an extended cutting or underreaming position. In other known underreaming devices, mechanical adjustment of the drill string connected to the underreamer and fluid or pneumatic pressure applied through the drill string is used to move cutters to the underreaming position. One such device is disclosed in U.S. Pat. No. 3,817,339. In other devices purely mechanical control is employed. Known controllable cutter underreaming tools generally suffer from a variety of disadvantages. For example, some underreamers require a sequence of longitudinal and/or angular movement on the drill string, connected to the underreamer, in combination with application and/or removal of fluid or pneumatic pressure, to control and actuate the cutters. It will be appreciated that the sequencing has to be done at the drilling rig at the top of the hole being drilled with the underreamer at some remote location down hole. Thus the correct sequencing of up and down movement and rotational movement and the air pressure or fluid pressure needs to be applied through the drill string to the underreamer at the surface of the hole. As a result it is quite easy to make a mistake in the sequencing and as a result cause the cutter arms to be extended and thereby underream in an area where underreaming is not required and even not desired, or fail to make the desired underreaming cut.

Additionally it has been found with some underreamers that when a drill is connected to the end of an underreamer and it is desired to drill a hole without underreaming, the cutter arms on the underreamer may inadvertently fly out under force created by the rotating underreamer and cutter arms. As a result, underreaming may occur in areas of the hole where it is undesirable.

It should be noted that underreaming at and only at the correct position in the hole is of extreme importance. For example, in mining operations it is desired to underream in a limited area towards the bottom of the hole so that when explosive material is positioned in the hole and detonated, all of the energy from the explosion is concentrated in the limited area. Therefore, should underreaming extend too high in the hole, a substantial reduction in efficiency will be found.

Additionally in pneumatically controlled devices, it has been found that leakage in the pneumatic system can cause malfunctioning of the underreamer and errors in the underreaming process.

It has also been found that many prior art devices involve complicated spring loaded or other actuating mechanisms which are costly and/or of questionable reliability.

BRIEF SUMMARY OF THE INVENTION

Briefly, a preferred embodiment of the present invention is an underreamer having longitudinally telescoping upper and lower portions connectable respectively to an upper drill string and a lower drill string. A splined connection is provided between the telescoping portions and has first and second connector parts, one carried by each of the telescoping portions. Each connector part has a plurality of grooves of staggered length and a plurality of keys of staggered length. The grooves and keys of one connector part are engageable and disengageable with, respectively, the keys and grooves of the other connector part. The splined connection has first and second engaged positions, both for transmitting torque between the telescoping portions. The splined connection provides a different angular and a different longitudinal position for the telescoping portions in each of such positions. Means is provided for pivotally mounting at least one cutter arm on one of the telescoping portions. Means is provided for urging the at least one cutter arm relatively outward from the telescoping portions to an extended underreaming position when the splined connection is in its first position. In the second position the cutter arm is retracted, for example, to a clearance position.

According to a preferred embodiment, means is provided on such other telescoping portion for locking the at least one cutter arm in a relatively inwardly retracted clearance position when the splined connection is in its second position.

According to another preferred embodiment of the invention there are plural cutter arms and means is provided for pivotally mounting such cutter arms on one of the telescoping portions. With such an embodiment, preferably means is provided on the other telescoping portion for urging the cutter arms relatively outwards towards an extended underreaming position when the telescoping portions are in the first position. The cutter arms are retracted relatively inwardly to a clearance position when the telescoping portions are in the second position.

With such arrangements an extremely low cost and relatively uncomplicated and easy to use underreamer is provided. In order to actuate the cutter arms to their retracted or extended underreaming positions, it is only necessary to follow a simple lift, rotate, and lower sequence of operations on the drill string connected to the underreamer. Maximum torque may be transmitted because of the splined connection.

According to a further preferred embodiment of the invention the means for urging the cutter arms comprises means operative in the second position of the splined for locking the cutter arms in their retracted position. As a result it is impossible for the cutter arms to be inadvertently moved outwards during rotation of the drill string and underreamer such as occurs when it is desired to drill without underreaming.

According to a further preferred embodiment of the invention the means on the telescoping portion also comprises means operative in the first position of the splined connection for locking the cutter arms in their underreaming position.

Preferably, a cam is provided for moving the cutter arms into their underreaming position during longitudinal movement of the splined connection towards the first position.

According to a still further preferred embodiment of the invention, the cutter arms have a cam follower on the end of the cutter arms on the opposite side of the pivotal mounting from the cutter carried on the cutter arm. The cam engages the cam followers in order to move the cutter arms towards their underreaming position during the longitudinal movement of the splined connection towards its first position.

According to an even further preferred embodiment of the invention, the cam has a slot for engaging the cam followers to thereby lock the cutter arms in their clearance position when the splined connection is in its second position.

According to a further preferred embodiment of the invention an outwardly facing ring shaped groove is positioned on the outer wall of the inner one of the telescoping portions and comprises a stop portion at one end. An inwardly facing ring shaped groove is adjacent to the outwardly facing groove and is positioned in the inner wall of the outer one of the telescoping portions. A plurality of balls are retained in both of the grooves for engaging the stop portion to stop longitudinal movement of the telescoping portions.

According to an even further preferred embodiment of the invention, a sleeve is carried by the upper portion and extends over the splined connection in both of its first and second positions, thereby providing a protective covering.

These and other features and advantages of the present invention will be appreciated as the same become better understood by reference to the following detailed description of the presently preferred embodiment when considered in connection with the accompanying drawings wherein:

DRAWINGS

DESCRIPTION

Figure 1:
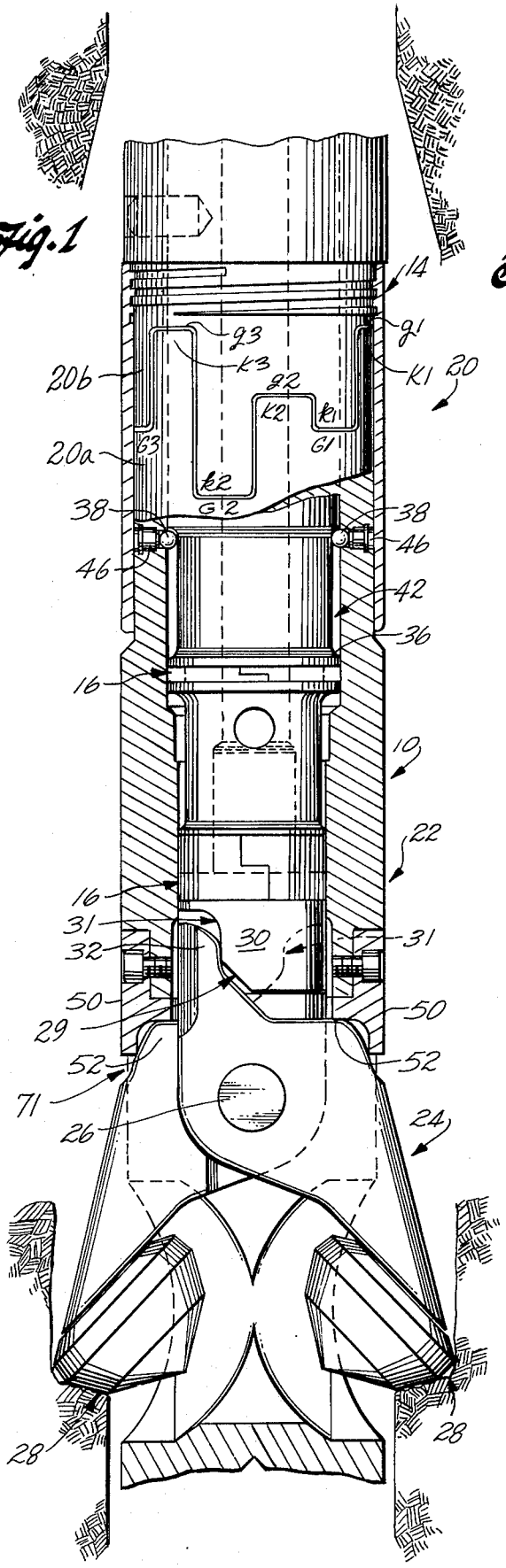
FIG. 1 is a longitudinal cross-section of the lower underreamer portion with the cutter arms extended and embodies the present invention.
Figure 2:
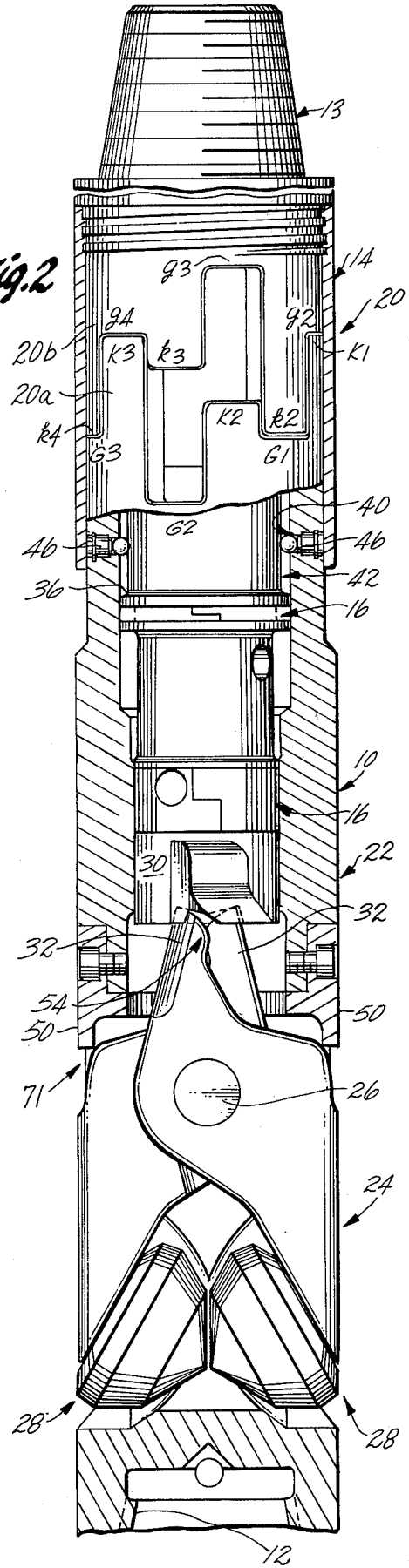
FIG. 2 is a longitudinal cross-section similar to FIG. 1 with the cutter arms retracted.

FIGS. 1 and 2 illustrate in side view and partially in section a combined underreamer and latching selector sub constructed according to the principles of the present invention. As illustrated in the present and preferred embodiment, the underreamer has a lower generally tubular shaped outer body portion 10 which may be connected to a lower portion of a drilling string by a conventional threaded female joint 12. The lower portion of the drill string (not shown) typically includes a conventional drill for forming a hole or bore in the earth as the drill string is rotated. Such drills are conventional, forming no part of the present invention, and are not further described herein. The drill is usually coupled directly to the underreamer. Also provided is an upper generally tubular shaped inner body portion 14. The upper body portion contains a threaded male joint 13 for connecting to the lower portion of an upper drill string (not shown). The upper and lower body portions 10 and 14 form longitudinally telescoping upper and lower body portions as they move relative to each other in a longitudinal direction.

The lower portion of the upper body portion 14 slides along the interior wall of the tubular shaped lower body portion 10. Low friction ring and seal bearings 16 are spaced apart longitudinally in grooves formed around the circumference of the lower portion of the lower body portion 14. Although the invention is not limited thereto, NYLATRON (a registered trademark) GS type bearings made by the Polymer Corporation are used. Significantly the ring and seal bearings 16 form virtually frictionless bearing surfaces on the interior wall of the lower body portion 10. This is quite important as it allows the upper telescoping portion 14 to be easily rotated relative to the lower portion 10 while the portion 10 is only held by friction in a hole being bored.

A splined connection 20 with two separable circular portions is provided in between the telescoping upper and lower body portions 14 and 10 at the tubular shaped portions thereof. Significantly, the splined connector 20 has a first and a second engaged position. Each position has a different angular and a different longitudinal engage position for the splined connection and hence the upper and lower telescoping portions 14 and 10.

The splined connection 20 has identical lower and upper portions 20a and 20b, respectively. The lower splined connector portion 20a includes longitudinally facing and staggered grooves G1,G2 . . . G5 and longitudinally facing and staggered keys K1,K2 . . . K6 in the lower body portion 10. Mating with the notches and grooves in the lower body portion are longitudinally facing and staggered grooves *g1,g2,g3 . . . g6,* and longitudinally facing and staggered keys *k1,k2, . . . k6* in the upper body portion *20b.* The keys and grooves are arranged into three 120° sections. The keys and grooves in one section are identical with those in each of the other sections. The keys and grooves are each 30° in width, although the invention is not limited thereto. Note with respect to FIG. 1 that keys *k1,k2 . . . k6* extend into and engage the grooves G1,G2 . . . G6 whereas the keys K1,K2 . . . K6 extend into and engage the grooves *g1,g2 . . . g6.* Not all keys and grooves can be seen in FIGS. 1 and 2. By longitudinally lifting the upper portion 14 (upward as depicted in FIG. 2) with respect to the lower portion 10 and rotating it clockwise 60° as viewed from the top and then allowing the upper portion 14 to move downwardly in the direction of the lower portion 10, different notches and keys become engaged. For example, in FIG. 2 the keys K1,K3 now extend into grooves *g2,g4*. Similarly, keys *k2,k4* now extend into and engage the grooves G1,G3. With such an arrangement the upper portion 14 is held in a different angular and longitudinal position with respect to the lower body portion 10 in FIG. 1 as compared with FIG. 2.

Thus the keys and grooves K1,G1,K2,G2 form one 120° angular section of the splined connection on the lower portion 10. Similarly, grooves and keys *g1,k1,g2,k2* form one 120° angular section of the portion of the splined connection on the upper portion 14. Two additional 120° angular sections of the splined connection are provided on the upper and lower telescoping portions 14 and 10 extending around the underreamer.

Figure 2A:
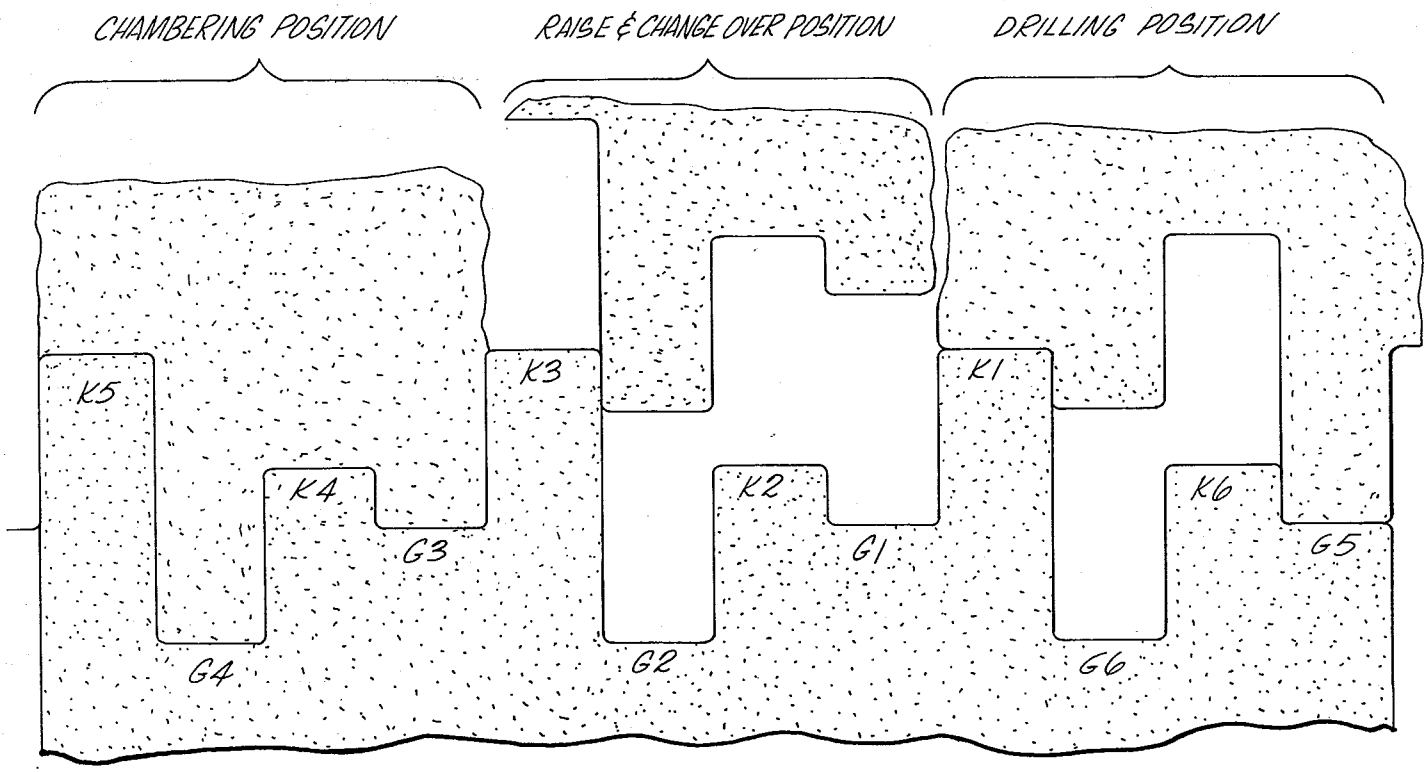
FIG. 2A is a flat pattern view depicting the three positions of the connector portions making up the splined connection.

FIG. 2A shows a flat pattern view of the circumference of the lower connector portion 20a with its keys and grooves. An example of one segment of the upper portion **20*b* of the connection 20 is shown above the lower connector portion 20*a* depicting the three positions of the splined connection 20**. From left to right the connector portions are in the chambering position, the changeover position and the drilling position.

A pair of cutter arms 24 are pivotally mounted on the lower body portion 10 by means of a pivot 26. The arms are pivotally mounted in a slot 71 which extends through the lower portion 10 from side to side transverse to the longitudinal axis of the underreamer. Only one half of the slot is seen in FIGS. 1 and 2, the other half being essentially a mirror image of the half shown.

Rock crushing cutters 28 of the conventional sort, and illustrated schematically, are rotatably mounted on the lower ends of the two cutter arms 24. On the lower end 22 of the upper portion 14 is a cam 30. A cam follower 32 is provided on each of the arms at the opposite end of the arms from the cutters 28. The cam follower 32 end of the arms 24 is about ½ the width of the center portion of the arms and the two arms are mounted on the pivot in a scissor fashion.

Also provided is a stop for limiting the extent of longitudinal movement between the upper and lower portions 14 and 10. The stop includes an elongated outwardly facing ring shaped groove 42 on the outer wall of the upper portion 14. The groove 42 has a stop portion 36 at the lower end of the groove 42 which, to be explained in more detail, engages balls to stop movement between the telescoping portions before the splined connection is moved longitudinally apart to a non-engageable position.

Also included in the stop is an inwardly facing ring shaped groove 40 adjacent to the outwardly facing groove 42 and positioned in the inner wall of the lower portion 10. Also included are a plurality of balls 38 which are retained in both of the grooves 40 and 42. In operation, the balls 38 engage the stop portion 36 of the groove 42 to stop the longitudinal movement between the upper and lower portions 14 and 10 at the extremity of their movement apart.

Three plugs 47 (only two being shown) are positioned into each of a plurality of openings drilled along different radii around the periphery of the lower portion 10 and adjacent to the groove 40. The openings are large enough for the balls 38 to be inserted therethrough and in between the grooves 40 and 42. The balls are positioned through these openings into the grooves and then each plug 46 is positioned in place, and locked by a "C" shaped retaining ring, to keep the balls 38 from sliding out of the grooves.

A tubular shaped sleeve **14*a* is threaded onto the upper portion 14. The sleeve 14*a* extends over the splined connection even when the upper portion 14 has been raised to its full extended position with the balls 38 in engagement with the stop portion 36. The sleeve 14*a* also extends over the plugs 46 when the splined connection 20 is in the underreaming position or the drilling position depicted in FIGS. 1 and 2, respectively. As a result, the plugs as well as the splined connection are protected from dirt and other debris encountered in drilling operations. However, the sleeve 14a will expose the plugs 46 when the upper and lower telescoping portions and hence the splined connector portions 20 are raised to the changeover position, thereby allowing access to the plugs 46** for assembly, disassembly or repair.

Two stop lugs 50 are bolted onto the lower portion 10 adjacent to the arms 24. Stop lugs 50 are inactive when the cutter arms are in their retracted position depicted in FIG. 1. When the cutter arms are extended as depicted in FIG. 2, a shoulder 52 on each of the arms 24 engages the respective stop lug and limits the outward movement of the cutter arms to a preselected extended position. Engagement of the shoulders with the stop lugs determines the size of the underreaming portion of the hole.

Figure 3:
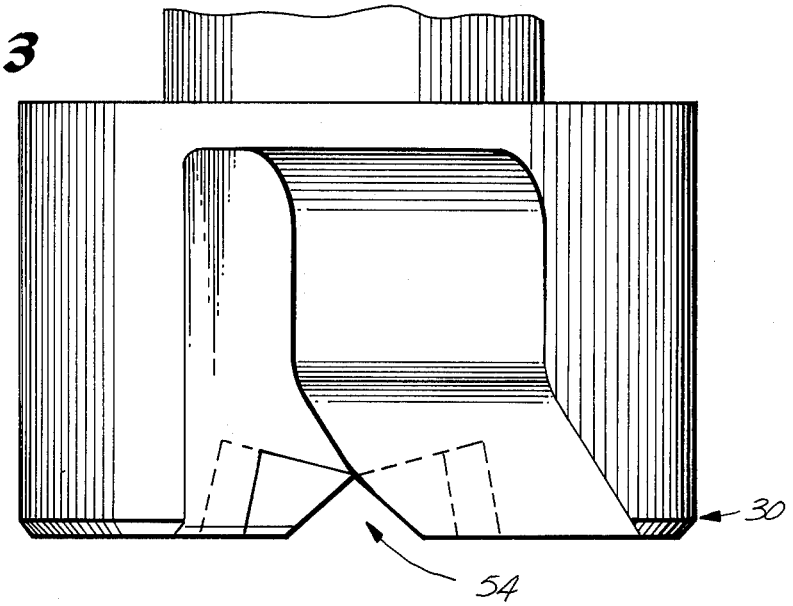
FIG. 3 is a side elevation view of the cam shown in FIGS. 1 and 2.
Figure 4:
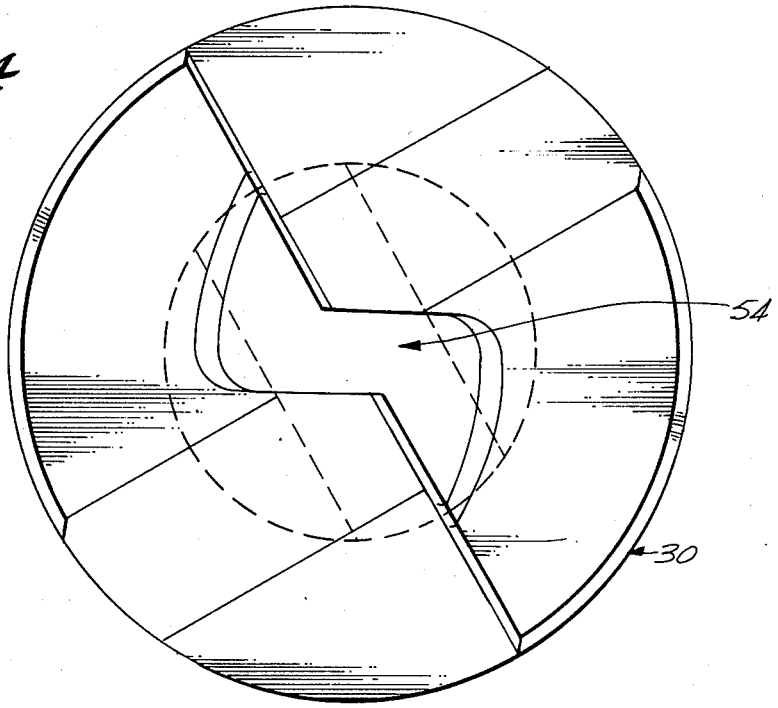
FIG. 4 is a bottom view of the cam shown in FIG. 3.

The cam 30 has a slot 54 into which the cam follower 32 ends of the arms 24 extend. The slot 54 is best seen in FIGS. 2, 3 and 4 and is dimensioned so as to engage the cam followers 32 and hold the arms in their clearance position depicted in FIG. 2 when the splined connection is in the position depicted in FIG. 2.

By providing the slot 54 at the end of the cam for engaging the cam followers, the cutter arms are held in their clearance position even when subjected to centrifugal force thereby preventing their inadvertent movement outwardly which may occur when the drill string is being rotated at a high speed.

Consider briefly the operation of the underreamer. An upper drill string is connected at the male threaded joint or connector 13 and a lower drill string is connected at the female threaded joint or connector 12. Assume that the underreamer is positioned in the condition depicted in FIG. 2. In this position the slot 54 in the cam 30 of the upper portion 14 holds the cutter arms 24 in the retracted clearance position. This is true even if the tool is rotated at high speed, subjecting the cutter arms to outward forces.

Should it be desired to extend the cutter arms 24 to simultaneously underream and drill, the upper drill string is raised from the drilling position of the splined connection 20 shown in FIG. 2 to the changeover position where the two portions of the splined connection 20 disengage, and then the upper drill string and hence the upper body portion 14 are rotated clockwise as viewed from the top until the side walls of keys *k2* and K3 strike. This will rotate the cam 30 to the position indicated in FIG. 1. The drill string and hence the upper portion 14 are then lowered to the chambering position of the splined connection 20 while the lower portion 10 is held in the hole until the cam surfaces 29 on the cam 30 act against the cam followers 32 and move the cutter arms 24 to the extended position shown in FIG. 1. The weight of the drill string will cause this action. The upper portion of the camming surfaces 29 form a lock 31 to lock the cutter arms in the extended position depicted in FIG. 1.

When the cutter arms are in either the clearance position of FIG. 2 or the extended position of FIG. 1, the splined connection 20 provides a series of substantially longitudinally extending side walls which provide torque transmission between the upper and lower portions 14 and 10 during drilling and/or underreaming operations. During underreaming operations when the connection 20 is in the chambering position, as depicted in FIG. 1, the adjacent side walls of the two connector portions 20*a* and 20*b* abut fully along their entire length, giving maximum torque transmission.

When it is desired to retract the cutter arms 24 from the extended to the clearance position, the upper drill string is again lifted upward, moving the upper portion 14 upward with respect to the lower portion 10 until the grooves and keys, which are engaged in FIG. 1, are disengaged. The cutter arms 24 will rotate back to the clearance position of FIG. 2, normally under their own weight. The upper drill string is then rotated counterclockwise as viewed from the top and then the drill string and upper portion 14 are allowed to move downward under their own weight until the splined connection 20 is engaged as depicted in FIG. 2, thereby holding the outer portion 14 in an upward position with respect to the position depicted in FIG. 1. In the process the slot 54 passes over the ends of the cam followers 32 and automatically locks the arms in the retracted clearance position of FIG. 2.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed:

1. An underreamer comprising:

longitudinally telescoping and relatively rotatable upper and lower portions connectable respectively to an upper drill string and a lower drill string;

first and second connector parts, one carried by each said telescoping portion, each said connector part comprising a plurality of grooves of staggered length and a plurality of keys of staggered length, the grooves and keys of one connector part being engageable and disengageable with, respectively, the keys and grooves of the other connector part, said connector parts having first and second engaged positions, both positions for transmitting torque between the telescoping portions, said connector parts providing a different angular position and a different longitudinal position for the telescoping portions in each said engaged position;

a plurality of cutter arms;

means for pivotally mounting the cutter arms on one of said telescoping portions; and means carried by the other telescoping portion for urging the cutter arms relatively outward towards an extended underreaming position when said connector parts are in said first position, the cutter arms being retracted relatively inwardly to a clearance position when said connector parts are in said second position.

2. An underreamer according to claim 1 wherein the means for urging comprises means operative in the second engaged position of said connector parts for locking the cutter arms in said clearance position.

3. An underreamer according to claim 1 wherein the means for urging comprises means operative in the first engaged position of said connector parts for locking said cutter arms in said underreaming position.

4. An underreamer according to claim 1 wherein the means for urging comprises a cam for moving said cutter arms into said underreaming position during longitudinal movement of said connector parts towards the first engaged position thereof.

5. An underreamer according to claim 4 comprising a cutter on each of said cutter arms, a cam follower on each of said cutter arms on the opposite side of the pivotal mounting from the corresponding cutter, said cam engaging said cam followers and moving said cutter arms towards said underreaming position during longitudinal movement of said connector parts towards the first engaged position thereof.

6. An underreamer according to claim 5 wherein said cam comprises a slot for engaging said cam followers and for locking said cutters arms in said clearance position when the connector parts are in said second engaged position.

7. An underreamer according to claim 1 comprising at least one stop on one of said telescoping portions for engaging and stopping the outward movement of each of said arms at a preselected extended underreaming position.

8. An underreamer according to claim 1 wherein said telescoping portions comprise a stop for limiting the extent of longitudinal movement apart of the connectors.

9. An underreamer according to claim 8 wherein said stop comprises:

an elongated outwardly facing ring shaped groove on the outer wall of an inner one of the telescoping portions comprising a stop portion at one end thereof;

an inwardly facing ring shaped groove adjacent to said outwardly facing groove and positioned in the inner wall of the outer one of said telescoping portions; and a plurality of balls retained in both said grooves for engaging said stop portion to stop longitudinal movement of said telescoping portions.

10. An angular position and weight actuated underreamer comprising:

longitudinally telescoping and relatively rotatable upper and lower portions connectable respectively to an upper drill string and a lower drill string;

first and second connector parts, one carried with each of said telescoping portions, each connector part comprising a plurality of grooves longitudinally extending and longitudinally staggered in length, a plurality of keys longitudinally extending and longitudinally staggered in length with at least one such key in between adjacent grooves, said connector parts providing first and second engaged positions therebetween for transmitting torque between said telescoping portions, said connector parts providing a different angular position and a different longitudinal position for the telescoping portions in each said position;

a plurality of cutter arms;

means for pivotally mounting the cutter arms on said lower telescoping portion; and a cam on said upper telescoping portion operative when moved longitudinally towards said first position for moving the cutter arms relatively outward towards an extended underreaming position, the cutter arms being retracted relatively inwardly to a clearance position when said connector parts are in said second engaged position.

11. An underreamer according to claim 10 comprising means operative in the second engaged position of said connector parts for locking the cutter arms in said clearance position.

12. An underreamer according to claim 10 comprising means operative in the first engaged position of said connector parts for locking said cutter arms in said underreaming position.

13. An underreamer according to claim 10 comprising a cutter on each of said cutter arms, a cam follower on each of said cutter arms on the opposite side of the pivotal mounting from the corresponding cutter, said cam engaging said cam followers and moving said cutter arms towards said underreaming position during longitudinal movement of said connector parts towards said first engaged position.

14. An underreamer according to claim 13 wherein said cam comprises a slot for engaging said cam followers and for locking said cutter arms in said clearance position when said connector parts are in said second engaged position.

15. An angular position and weight actuated underreamer comprising:

longitudinally telescoping and relatively rotatable inner and outer portions connectable respectively to an upper drill string and a lower drill string;

a splined connection between said telescoping portions comprising a plurality of grooves and keys on each telescoping portion, the grooves and keys on the telescoping portion being engageable and disengageable with respectively keys and grooves in the outer telescoping portion, said grooves being relatively staggered longitudinally and said keys being relatively staggered longitudinally on each telescoping portion thereby providing first and second engaged positions for the splined connection, both positions for transmitting torque between the telescoping portions, said splined connection providing a different angular and a different longitudinal position for the telescoping portions in each said position;

a plurality of cutter arms;

means for pivotally mounting the cutter arms on said outer telescoping portion; and means on said inner telescoping portion for urging the cutter arms relatively outward toward an extended underreaming position when said splined connection is in said first position, the cutter arms being retracted relatively inwardly to a clearance position when said splined connection is in second position.

16. An underreamer according to claim 15 wherein said keys and grooves each comprise substantially longitudinally extending side walls on the respective telescoping portion, said side walls on one telescoping portion engaging with side walls in the other for providing such torque transmission.

17. An underreamer according to claim 16 wherein said splined connection is tubular in shape.

18. An underreamer according to claim 17 comprising a sleeve carried by one of said telescoping portions which extends over said splined connection in both said positions.

19. An underreamer comprising:

longitudinally telescoping and relatively rotatable upper and lower portions connectable respectively to an upper drill string and a lower drill string;

first and second connector parts, one carried by each said telescoping portion, each said connector part comprising a plurality of grooves of staggered length and a plurality of keys of staggered length, the grooves and keys of one connector part being engageable and disengageable with, respectively, the keys and grooves of the other connector part said connector parts having first and second engaged positions, both positions for transmitting torque between the telescoping portions, said connector parts providing a different angular and a different longitudinal position for the telescoping portions in each said position;

means for pivotally mounting at least one cutter arm on one of said telescoping portions; and means for urging such at least one cutter arm relatively outward from the telescoping portions to an extended underreaming position when said connector parts are in said first position, said cutter arm being capable of retraction to an inward position when said connector parts are in said second position.

20. An underreamer according to claim 19 comprising means for locking such at least one cutter arm in such relatively inward position when said connector parts are in said second position.

* * * * *

UNITED STATES PATENT AND TRADEMARK OFFICE

CERTIFICATE OF CORRECTION

PATENT NO. : 4,055,226

DATED : Oct. 25, 1977

INVENTOR(S) : Robert W. Weber

It is certified that error appears in the above-identified patent and that said Letters Patent are hereby corrected as shown below:

Column 1, line 18, "desired" should be -- desirable --;
line 38, "or like" should be -- or the like --;
Column 3, line 6, insert -- connection -- after "splined";
Column 4, line28, end of line, "lower" should be -- upper --;
Column 5, line 61, "47" should be -- 46 --;
Column 9, line 35, "the" should be -- one --;
line 37, "outer" should be -- other --;
Column 10, line 6, "in second" should be -- in said second --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*